US007375711B2

(12) United States Patent
Horiuchi et al.

(10) Patent No.: US 7,375,711 B2
(45) Date of Patent: May 20, 2008

(54) ELECTRO-OPTICAL DEVICE, METHOD OF DRIVING THE SAME AND ELECTRONIC APPARATUS

(75) Inventors: Hiroshi Horiuchi, Matsumoto (JP); Hiroaki Jo, Suwa (JP); Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 620 days.

(21) Appl. No.: 10/885,771

(22) Filed: Jul. 8, 2004

(65) Prior Publication Data

US 2005/0057581 A1 Mar. 17, 2005

(30) Foreign Application Priority Data

Aug. 25, 2003 (JP) ..... 2003-300034

(51) Int. Cl.
*G09G 3/36* (2006.01)

(52) U.S. Cl. ..... 345/89

(58) Field of Classification Search ..... 345/76–100, 345/690–693, 211, 213; 315/169.3
See application file for complete search history.

(56) References Cited

U.S. PATENT DOCUMENTS

| | | | | |
|---|---|---|---|---|
| 6,690,388 | B2 | 2/2004 | Kasahara et al. | |
| 6,927,784 | B2 * | 8/2005 | Matsuda et al. | 345/690 |
| 6,980,180 | B2 | 12/2005 | Hasagawa | |
| 6,987,521 | B2 * | 1/2006 | Mori et al. | 345/690 |
| 7,042,524 | B2 | 5/2006 | Onagawa | |
| 2002/0171615 | A1 * | 11/2002 | Inoue et al. | 345/92 |
| 2002/0180680 | A1 * | 12/2002 | Moon | 345/89 |
| 2003/0001806 | A1 * | 1/2003 | Bae et al. | 345/77 |
| 2003/0058211 | A1 * | 3/2003 | Kim et al. | 345/89 |
| 2004/0032522 | A1 * | 2/2004 | Koeda et al. | 348/333.12 |
| 2004/0036703 | A1 * | 2/2004 | Aoki et al. | 345/690 |
| 2005/0140631 | A1 * | 6/2005 | Oh et al. | 345/89 |

FOREIGN PATENT DOCUMENTS

| | | |
|---|---|---|
| JP | A 06-034946 | 2/1994 |
| JP | A 08-084309 | 3/1996 |
| JP | A 2002-142132 | 5/2002 |
| JP | A 2003-198984 | 7/2003 |
| JP | A 2003-228331 | 8/2003 |

* cited by examiner

*Primary Examiner*—Alexander Eisen
*Assistant Examiner*—Cory A Almeida
(74) *Attorney, Agent, or Firm*—Oliff & Berridge, PLC

(57) ABSTRACT

To provide a method for manufacturing an electro-optical device that is capable of controlling more smoothly brightness as compared with a control in every one frame and preventing large current from flowing when switching frames in a peak brightness control, a method of driving the same, and an electronic apparatus. A grayscale data average value operation unit 33 performs, for each line, an average value calculation of grayscale levels of images corresponding to images of an one-frame-length and outputs, based on average value for the one frame-length, mode signals M1 to M4 for brightness control in each line. A driver input data converter 34 rewrites, based on the mode signals M1 to M4 from the grayscale data average value operation unit 33, grayscale data HD for one line among grayscale data from a frame memory 31 into grayscale data DD. The driver input data converter 34 outputs grayscale data DD which is image data for the one frame-length and whose brightness is adjusted in a signal generating circuit.

9 Claims, 10 Drawing Sheets

ELECTRO-OPTICAL DEVICE, METHOD OF DRIVING THE SAME AND ELECTRONIC APPARATUS

BACKGROUND OF THE INVENTION

1. Field of Invention

The present invention relates to an electro-optical device, a method of driving the same and an electronic apparatus.

2. Description of Related Art

Conventionally, electro-optical devices such as liquid crystal display devices employing liquid crystal elements, organic electroluminescent display devices employing organic electroluminescent elements, electrophoresis devices employing electrophoresis elements are known. In such electro-optical devices, when displaying images, a brightness control (a peak brightness control) is performed such that for relatively dark grayscale display, overall brightness becomes higher and for relatively bright grayscale display, overall brightness becomes lower. See, for example, Japanese Unexamined Patent Application Publication No. 6-34946. Typically, in the peak brightness control, from image data for one frame in every one frame, general brightness of the frame is obtained. And then, based on the obtained general brightness, a judgment is preformed on whether image of the frame is bright image or dark image, and thus overall brightness is adjusted. By performing the peak brightness control, it is easy to view a screen and a consumption of power can be decreased.

However, in the above-mentioned peak brightness control, general brightness of the frame is obtained in every one frame and overall brightness is controlled. Accordingly, if a brightness change between frames is large in such a manner that frame image is changed from full black to full white, a large current abruptly flows when switching frames, thereby causing a noise. Besides, it is necessary for a power source circuit having high driving ability, which supplies electric power for each pixel circuit to drive the electro-optical device.

SUMMARY OF THE INVENTION

The present invention has been made to solve the above problems, and it is an object of the present invention to provide an electro-optical device that is capable of controlling more smoothly as compared with a control in every one frame and preventing a large current from flowing when switching frames in a brightness control (a peak brightness control), a method of driving the electro-optical device and an electronic apparatus.

An electro-optical device of the present invention comprises: a plurality of scanning lines; a plurality of data lines; pixel circuits having electro-optical elements respectively provided corresponding to intersections of the plurality of scanning lines and the plurality of data lines; and a brightness control circuit for controlling the brightness of the electro-optical element of each pixel circuit, based on grayscale data, to control peak brightness, the brightness control circuit comprising: a brightness state judging circuit for, whenever grayscale data for one line or plural lines is inputted, calculating a brightness state for one frame-length including the one line or plural lines and judging the brightness state based on the calculation result; and a brightness control circuit for, whenever grayscale data for one line or plural lines is inputted, controlling the brightness of electro-optical elements of pixel circuits for one line or plural lines based on the judgment result of the brightness state judging circuit.

According to this configuration, whenever grayscale data for one line or plural lines is inputted, a brightness state for one-frame-length including the line or plural lines is calculated, and a judgment of the brightness state for one-frame-length is performed based on the calculation result. Subsequently, whenever grayscale data for one line or plural lines is inputted, brightness for one-frame-length including the line is controlled based on the judgment result. Since a change of the brightness state is less for one line or plural lines than for one frame, brightness can be smoothly controlled. Accordingly, it is possible to prevent a large current from flowing when switching frames. Further, it is possible to make little a change of electric power which a power source circuit supplies for each pixel circuit to drive the electro-optical device.

In the electro-optical device, the brightness state judging circuit may comprises: a first adding circuit for, whenever grayscale data for one line or plural lines is inputted, respectively adding grayscale data for the one line or plural lines; a shift circuit for holding the addition result of the first adding circuit for the one frame-length; a second adding circuit for, whenever grayscale data for one line or plural lines is inputted, respectively adding output data of the shift circuit corresponding to the number of lines for the one frame-length including the one line or plural lines; a judging circuit for, whenever grayscale data for one line or plural lines is inputted, judging the brightness state for the one frame-length including the one line or plural lines based on the addition result of the second adding circuit; and a brightness mode selecting circuit for selecting one mode from a plurality brightness modes based on the judgment result of the judging circuit.

According to this configuration, by assembling an adding/subtracting circuit, in every one line or every plural lines, it is possible to calculate and judge a brightness state for one-frame-length including the line or plural lines. Thus, it is possible to control more smoothly brightness of an electro-optical device with only a small operation load. Further, it is possible to make little a change of electric power which a power source circuit supplies for each pixel circuit to drive the electro-optical device.

In the electro-optical device, the brightness state judging circuit comprises: a first adding circuit for, whenever grayscale data for one line or plural lines is inputted, respectively adding grayscale data for the one line or plural lines; a first shift circuit for holding the addition result of the first adding circuit for the one frame-length; a second adding circuit for, whenever grayscale data for one line or plural lines is inputted, respectively adding output data of the first shift circuit corresponding to the number of lines for the one frame-length including the one line or plural lines; a second shift circuit for holding the addition result of the second adding circuit for multiple frame-lengths; a third adding circuit for, whenever grayscale data for one line or plural lines is inputted, respectively adding output data of the second shift circuit corresponding to the number of lines for the multiple frame-lengths including the one line or plural lines; a judging circuit for, whenever grayscale data for one line or plural lines is inputted, judging the brightness state for the one frame-length including the one line or plural lines based on the addition result of the third adding circuit; and a selecting circuit for selecting one mode from a plurality brightness modes based on the judgment result of the judging circuit.

According to this configuration, since brightness state for multi-frame-length is calculated and judged, it is possible to slowly control brightness with a larger time constant. Accordingly, it is possible to control and set brightness in conformity with eyesight characteristics of man and characteristics of a device. Further, it is possible to make little a change of electric power which a power source circuit supplies for each pixel circuit to drive the electro-optical device.

In the electro-optical device, the brightness state judging circuit comprises: a selecting circuit for selecting one of the addition result of the second adding circuit and the addition result of the third adding circuit according to changes in the brightness state for the one frame-length; a judging circuit for, whenever grayscale data for one line or plural lines is inputted, judging the brightness state for the one frame-length including the one line or plural lines based on the selection result of the selecting circuit; and a brightness mode selecting circuit for selecting one mode from a plurality of brightness modes based on the judgment result of the judging circuit.

According to this configuration, it is possible to calculate and judge a brightness state selectively for one-frame-length or multi-frame-length according to a change of a brightness state for one-frame-length. For example, when brightness darkens, it is possible to calculate and judge a brightness state for multi-frame-length according to characteristics of man's eye and change the brightness state slowly, as compared with the case in which brightness brightens. Therefore, it is possible to control brightness more naturally.

Further, for example, in the case that a slow brightness change is not required when brightness brightens, a brightness state for one-frame-length is calculated and judged. Accordingly, it is possible to control and set brightness in conformity with eyesight characteristics of man and characteristics of a device. Further, it is possible to make little a change of electric power which a power source circuit supplies for each pixel circuit to drive the electro-optical device.

In the electro-optical device, the brightness control circuit may comprise a converting circuit for converting grayscale data according to a brightness mode selected by the brightness mode selecting circuit.

According to this configuration, since it is possible to select one mode from a plurality of brightness modes to be previously prepared according to a change of the brightness state, it is possible to control brightness more flexibly. Further, if the conversion of grayscale data is performed in accordance with grayscale characteristics provided by folding lines, it is possible to perform a conversion by means of shift and addition/subtraction, and thus it is possible to reduce an operation load when a conversion of grayscale data.

In the electro-optical device, the brightness control circuit may set one of a plurality of light-emitting intervals of the pixel circuits according to a brightness mode selected by the brightness mode selecting circuit.

According to this configuration, it is possible to select one from a plurality of light-emitting intervals according to a change of a brightness state, thereby controlling the brightness more flexibly.

Further, it is not necessary to perform a conversion of grayscale data, thereby reducing an operation load when a conversion of grayscale data.

A method of driving an electro-optical device comprising a plurality of scanning lines, a plurality of data lines, pixel circuits having electro-optical elements respectively provided corresponding to intersections of the plurality of scanning lines and the plurality of data lines and a brightness control circuit for controlling the brightness of the electro-optical element of each pixel circuit, based on grayscale data, to control peak brightness, comprises: whenever grayscale data for one line or plural lines is inputted, calculating a brightness state for one frame-length including the one line or plural lines and judging the brightness state based on the calculation result; and whenever grayscale data for one line or plural lines is inputted, controlling the brightness for the one line or plural lines based on the judgment result.

According to this configuration, whenever grayscale data for one line or plural lines is inputted, a brightness state for one-frame-length including the line or plural lines is calculated, and a judgment of the brightness state for one-frame-length is performed based on the calculation result. Subsequently, whenever grayscale data for one line or plural lines is inputted, brightness for one-frame-length including the line is controlled based on the judgment result. Since a change of the brightness state is less for one line or plural lines than for one frame, brightness can be smoothly controlled. Accordingly, it is possible to prevent a large current from flowing when switching frames. Further, it is possible to make little a change of electric power which a power source circuit supplies for each pixel circuit to drive the electro-optical device. Further, since a change of the brightness state is less for one line or plural lines than for one frame, it is possible to make little an operation load of a brightness state calculation.

In the method of driving an electro-optical device, the control of brightness for one line or plural lines based on the judgment result may be performed by changing the grayscale data.

According to this configuration, by changing the grayscale data, the brightness states of the pixel circuits are adjusted.

In the method of driving an electro-optical device, the control of the brightness for one line or plural lines based on the judgment result is performed by changing a driving interval of the electro-optical element.

According to this configuration, by changing a driving interval of the electro-optical element, the brightness states of the pixel circuits are adjusted.

An electronic apparatus according to the present invention comprises an electro-optical device mounted thereon.

According to the configuration, it is possible to control the brightness of the electro-optical device more smoothly and then it is possible to make little a change of electric power which a power source circuit supplies for each pixel circuit to drive the electro-optical device.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

First Embodiment

Figure 1:
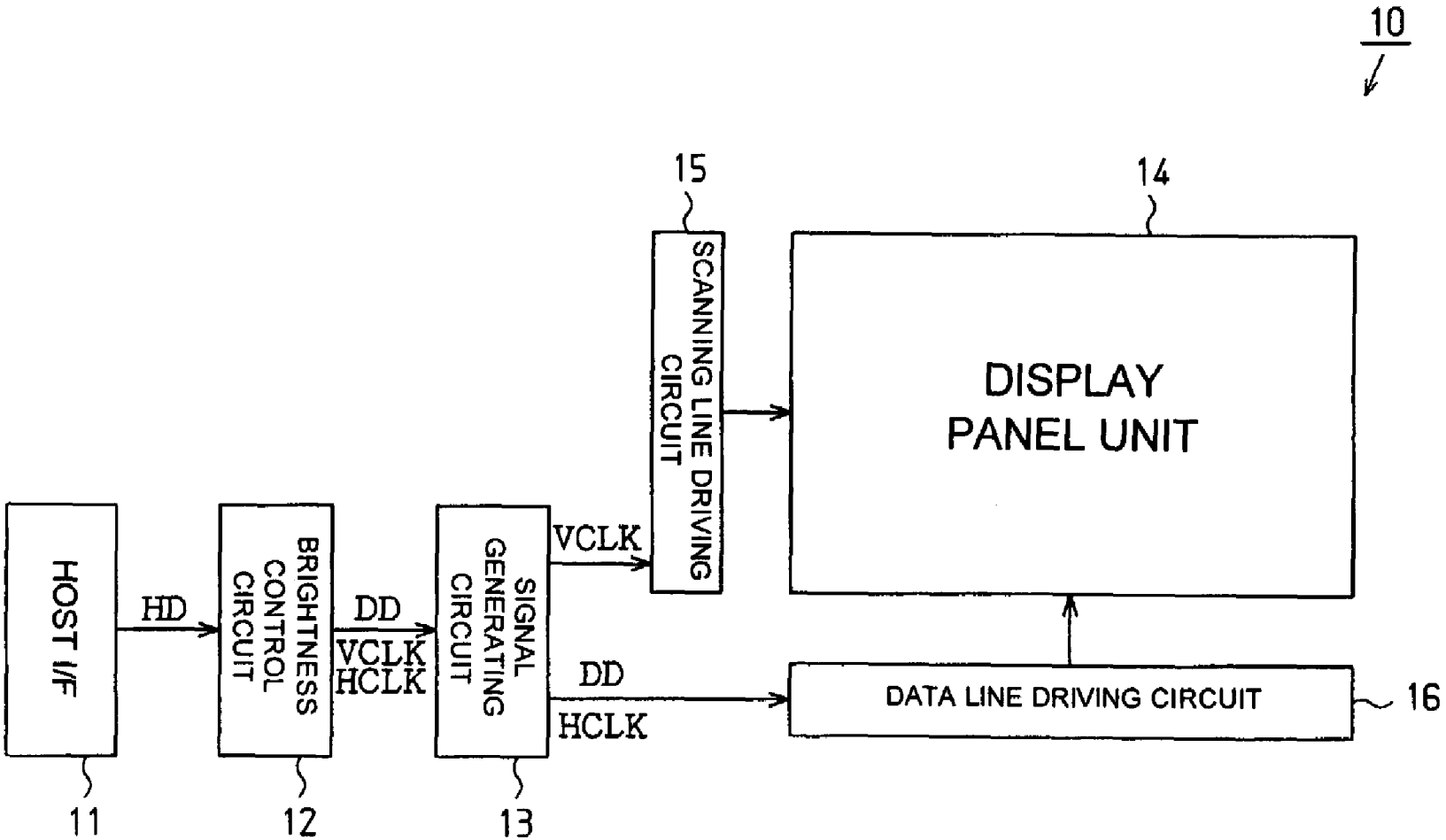
FIG. 1 is a block circuit diagram showing an electric configuration of an organic electroluminescent display device of a first embodiment.
Figure 2:
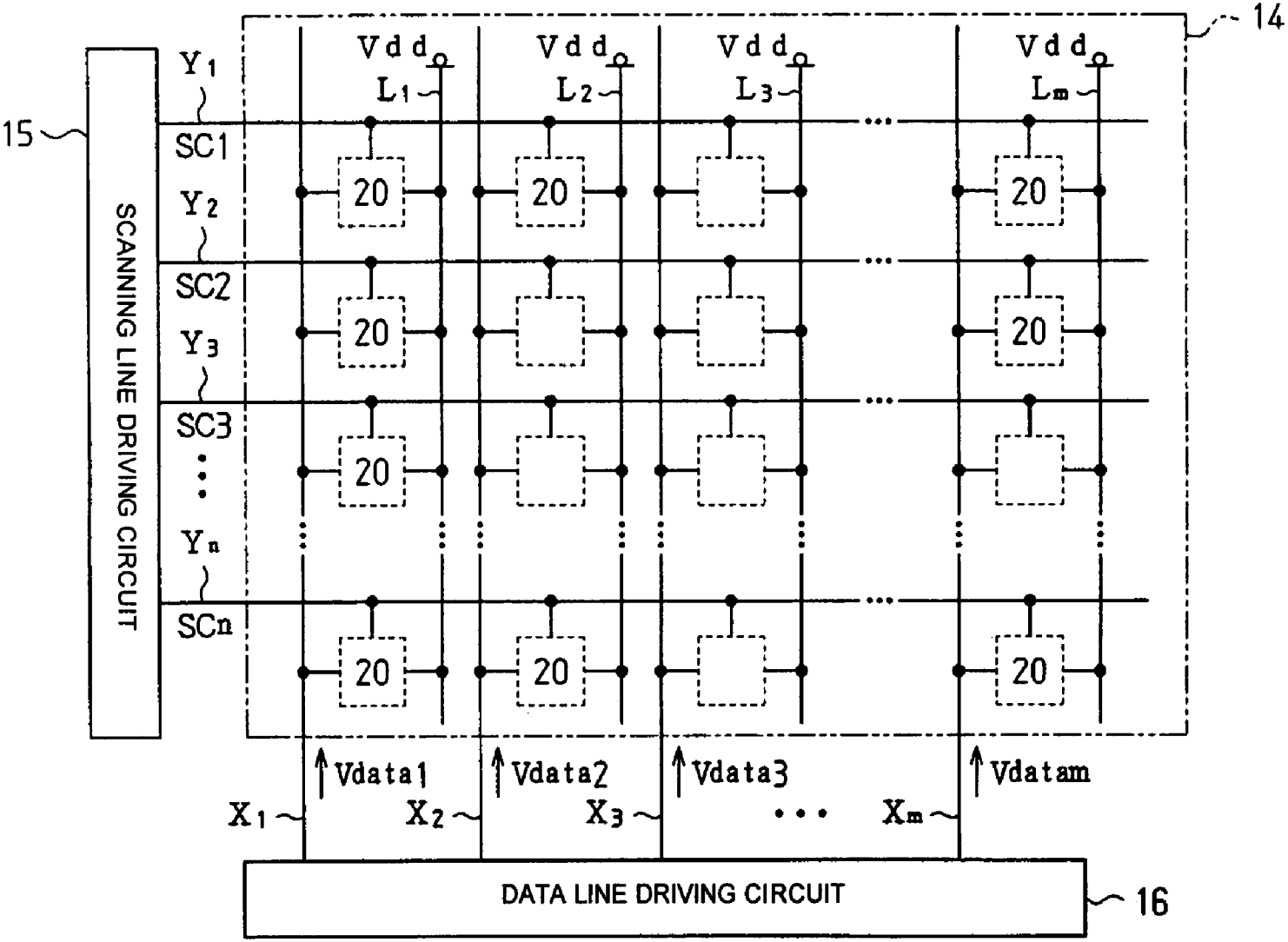
FIG. 2 is a block circuit diagram showing a circuit configuration of a display panel in the organic electroluminescent display device of the first embodiment.
Figure 3:
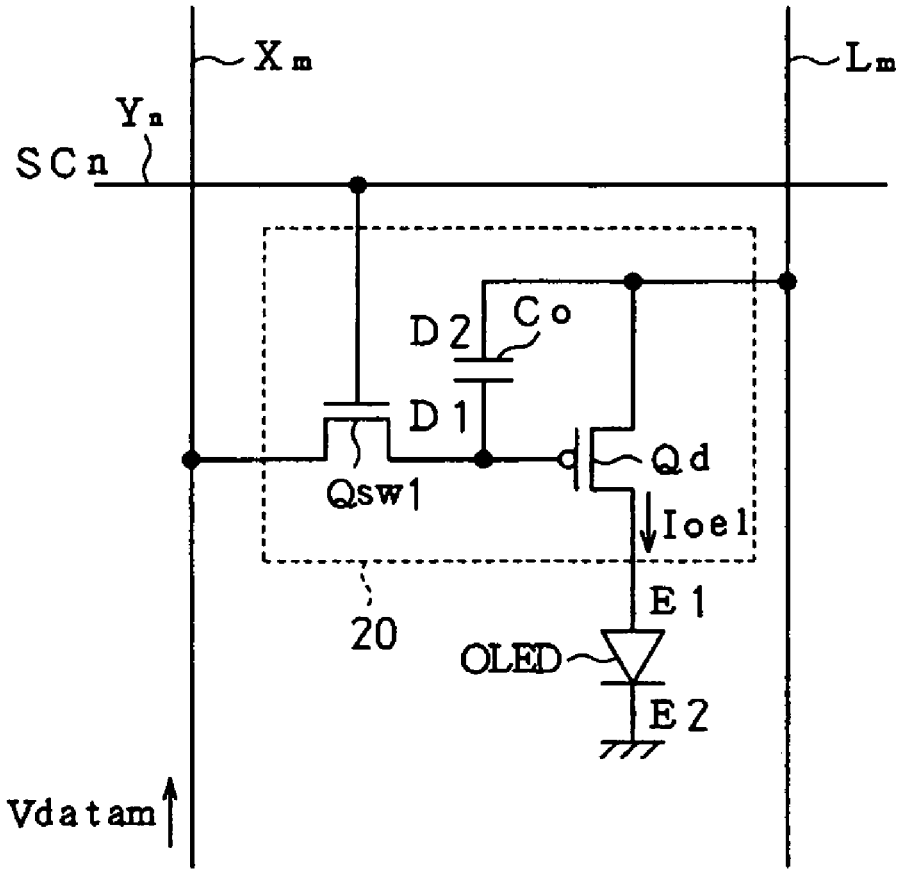
FIG. 3 is a circuit diagram of a pixel circuit in the organic electroluminescent display device of the first embodiment.

A first embodiment implementing the present invention will be now described with reference to FIGS. 1 to 5. FIG. 1 is a block circuit diagram showing an electric configuration of an organic electroluminescent display device using an organic electroluminescent element as an electro-optical device. FIG. 2 is a block circuit diagram showing a circuit configuration of a display panel unit. FIG. 3 is a circuit diagram showing an inside configuration of a pixel circuit.

The organic electroluminescent display device 10 comprises a host I/F 11, a brightness control circuit 12 as a brightness control circuit, a signal generating circuit 13, a display panel unit 14, a scanning line driving circuit 15, and a data line driving circuit 16. In addition, the organic electroluminescent display device 10 in the present embodiment has an active matrix driving method.

The brightness control circuit 12, the signal generating circuit 13, the scanning line driving circuit 15 and the data line driving circuit 16 of the organic electroluminescent display device 10 may be configured by independent electronic components, respectively. For example, the brightness control circuit 12, the signal generating circuit 13, the scanning line driving circuit 15, and the data line driving circuit 16 may be configured by one-chip semiconductor integrated circuit devices, respectively. In addition, all or some of the brightness control circuit 12, the signal generating circuit 13, the scanning line driving circuit 15, and the data line driving circuit 16 may be configured by programmable IC chips, and the functions thereof may be carried out by software programs written in the IC chips.

The host I/F 11 serving as an external device outputs grayscale data HD for displaying images to the brightness control circuit 12. The brightness control circuit 12 performs signal processing for peak brightness control based on the grayscale data HD, and outputs the grayscale data DD whose peak brightness is adjusted by the signal processing to the signal generating circuit 13. Further, the brightness control circuit 12 generates a system clock SCLK, a frame synchronizing signal FCLK, a vertical synchronizing signal VCLK and a horizontal synchronizing signal HCLK, and outputs them to the signal generating circuit 13.

The signal generating circuit 13 generates 8-bit image data based on the grayscale data DD from the brightness control circuit 12 and outputs the generated 8-bit image data to the data line driving circuit 16. Further, the signal generating circuit 13 outputs the vertical synchronizing signal VCLK to the scanning line driving circuit 15 and outputs the horizontal synchronizing signal HCLK to the data line driving circuit 16.

The display panel unit 14, as shown in FIG. 2, includes m data lines X1, X2, . . . , Xm (m is natural number) extending along column directions. Further, the display panel 14 includes n scanning lines Y1, Y2, . . . , Yn (n is natural number) extending along row directions.

In the display panel unit 14, pixel circuits 20 are arranged at positions corresponding to intersections of the respective data lines Xm and the respective scanning lines Yn. The respective pixel circuits 20 are connected to the data line driving circuit 16 via the data lines X1, X2, . . . , Xm. Further, the respective pixel circuits 20 are connected to the scanning line driving circuit 15 via the scanning lines Y1, Y2, . . . , Yn. Here, it is assumed that the m data lines X1, X2, . . . , Xm are formed in the order from the left to the right in FIG. 2. Similarly, it is assumed that the n scanning lines Y1, Y2, . . . , and Yn are formed in the order from the top to the bottom in FIG. 2. In addition, the respective pixel circuits 20 are connected to m power lines L1, L2, . . . , Lm (m is natural number) extending along column directions. Accordingly, a driving voltage Vdd is supplied for the respective pixel circuits 20 via the power lines L1, L2, . . . , Lm.

FIG. 3 is a circuit diagram showing an inside configuration of a pixel circuit 20 that is arranged to correspond to an intersection of an m-th data line Xm and an n-th scanning line Yn. The pixel circuit 20 comprises two transistors, one capacitor element, and one organic electroluminescent element as an electro-optical element. In detail, the pixel circuit 20 comprises a driving transistor Qd, a switching transistor Qsw1, a storage capacitor Co and an organic electroluminescent element OLED. The driving transistor Qd is a p-type TFT, and the switching transistor Qsw1 is an n-type TFT. Further, the organic electroluminescent element OLED, as an electronic element or a light-emitting element, whose light-emitting layer is made of an organic material, is a light-emitting element that emits light when a driving current is supplied therefor.

A source of the driving transistor Qd is connected to the m-th power line Lm that supplies the driving voltage Vdd. A drain of the driving transistor Qd is connected to an anode E1 of the organic electroluminescent element OLED. A cathode E2 of the organic electroluminescent element OLED is grounded. Further, a first electrode D1 of the storage capacitor Co is connected to a gate of the driving transistor Qd. A second electrode D2 of the storage capacitor Co is connected to the power line Lm.

A gate of the switching transistor Qsw1 is connected to the n-th scanning line Yn. Further, a drain of the switching transistor Qsw1 is connected to the m-th data line Xm and a source of the switching transistor Qsw1 is connected to the gate of the driving transistor Qd. Moreover, in the present embodiment, the pixel circuit 20 comprises the driving transistor Qd, the switching transistor Qsw1, the storage capacitor Co and the organic electroluminescent element OLED, but the present invention is not limited to this configuration and may be appropriately modified.

The scanning line driving circuit 15, based on the vertical synchronizing signal VCLK from the signal generating circuit 13, selects one scanning line among n scanning lines Y1, Y2, . . . , Yn provided in the display panel unit 14, and outputs a corresponding one of scanning signals SC1 to SCn (n is natural number) to the selected scanning line. Subsequently, a timing at which charges corresponding to a data voltage which is outputted from the data line driving circuit 16 in response to the respective scanning signals SC1 to SCn are written in a storage capacitor Co, and a timing at which the respective organic electroluminescent elements OLED emit are controlled.

Outputted from the signal generating circuit 13, 8-bit grayscale data DD and a horizontal synchronizing signal HCLK are inputted to the data line driving circuit 16. The data line driving circuit 16 generates data voltages Vdata1 to Vdatam (m is natural number) which are supplied for the respective pixel circuits 20 on the selected scanning line based on grayscale data DD. In other words, whenever the respective scanning lines are sequentially selected, the data line driving circuit 16 generates the respective data voltages Vdata1 to Vdatam to be supplied for the respective pixel circuits 20 on the selected scanning line based on 8-bit grayscale data DD and outputs them to the respective pixel circuits 20 through the data lines X1 to Xm.

Subsequently, in the respective pixel circuits 20 on the scanning line Y1 to $Y_n$ selected by the respective scanning signals SC1 to $SC_n$ to be sequentially outputted from the scanning line driving circuit 15, the switching transistors Qsw1 are set to be turned-on state. In such a manner, charges corresponding to the respective data voltages Vdata1 to Vdatam which are outputted from the data line driving circuit 16 to the respective pixel circuits 20 through the respective data lines X1 to Xm are written in the respective storage capacitors Co through the switching transistors Qsw1. If so, in the driving transistors Qd, driving current Ioel having a value corresponding to the charges written in the respective storage capacitors Co flows. Accordingly, the respective organic electroluminescent elements OLED emit with a brightness grayscale level corresponding to the driving current Ioel (data voltage value).

Next, the brightness control circuit 12 which processes grayscale data from the above-mentioned host I/F 11 as an external device for a peak brightness control and outputs the brightness-adjusted grayscale data by means of the above process to the signal generating circuit 13, will be described with reference to FIGS. 4 to 8.

Figure 4:
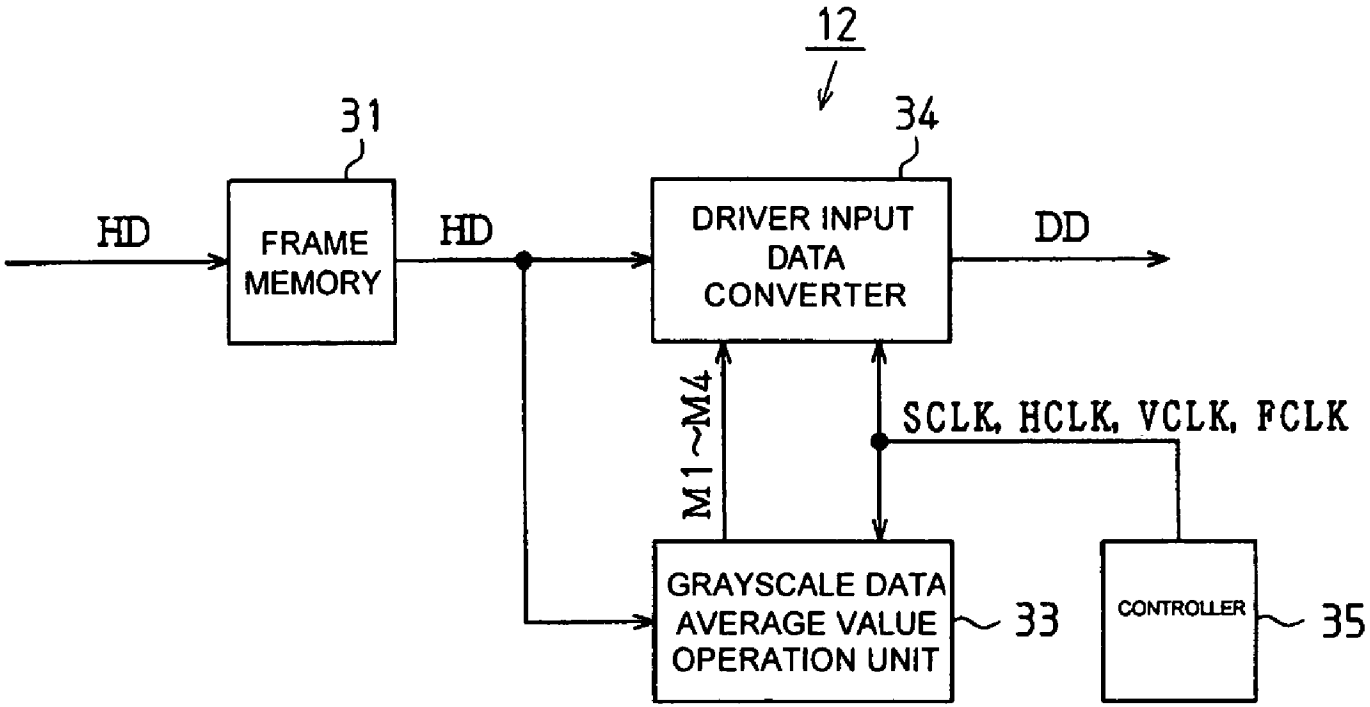
FIG. 4 is a view showing an inside configuration of a brightness control circuit in the organic electroluminescent display device of the first embodiment.

FIG. 4 is a view showing an inside configuration of the brightness control circuit 12. As shown in FIG. 4, the brightness control circuit 12 comprises a frame memory 31, a grayscale data average value operation unit 33 as a brightness state judging circuit, a driver input data converter 34 as the brightness control circuit and converting circuit, and controller 35.

A frame memory 31 stores 8-bit grayscale data HD for image display from the host I/F 11 for one frame, that is, grayscale data HD for n×m pixel circuits 20 formed in the display panel unit 14. The frame memory 31 reads grayscale data for one line (m×8-bit) in the stored grayscale data HD for one frame (n×m×8-bit), that is, for m pixel circuits 20 connected to one scanning line and outputs them to the grayscale data average value operation unit 33 and the driver input data converter 34.

The grayscale data average value operation unit 33 receives the system clock SCLK, the frame synchronizing signal FCLK, the vertical synchronizing signal VCLK and the horizontal synchronizing signal HCLK from the controller 35. In addition, the grayscale data average value operation unit 33 receives grayscale data HD from the frame memory 31 in synchronization with the horizontal synchronizing signal HCLK from the controller 35. Further, the grayscale data average value operation unit 33 operates an average value for one-frame-length, that is, a brightness state for n×m grayscale data in synchronization with the vertical synchronizing signal VCLK, that is, whenever grayscale data HD for one line is inputted from the frame memory 31. When receiving grayscale data HD for one line, the grayscale data average value operation unit 33 removes the oldest grayscale data HD for one line among grayscale data HD for one-frame-length previously stored, and replace it with newly inputted grayscale data HD for one line (update). This update is performed whenever grayscale data HD for one line is inputted. Further, the grayscale data average value operation unit 33 obtains general brightness of grayscale data HD for one-frame-length after the update, whenever the update is performed, and calculates an average value of brightness for one-frame-length at that time by dividing the obtained general brightness by the number of overall pixel circuits 20 (n×m).

Moreover, in the present invention, in order to reduce a load of an operation process, the grayscale data average value operation unit 33 calculates an average value of brightness for one-frame-length using only an upper 2-bit of 8-bit grayscale data HD.

After obtaining the average value, the grayscale data average value operation unit 33 judges a mode to which the average value belongs. In other words, the grayscale data average value operation unit 33 judges the average value of 0 to 25 as a first mode representing very dark state as a whole, and the average value of 26 to 50 as a second mode representing a little dark state as a whole. In addition, the grayscale data average value operation unit 33 judges the average value of 51 to 75 as a third mode representing a little bright state as a whole and the average value of 76 to 100 as a fourth mode representing very bright state as a whole. The grayscale data average value operation unit 33 outputs to the driver input data converter 34 a first mode signal M1 when judge as the first mode, and a second mode signal M2 when judge as the second mode. Further, the grayscale data average value operation unit 33 outputs to the driver input data converter 34 a third mode signal M3 when judge as the third mode, and a fourth mode signal M4 when judge as the fourth mode.

The driver input data converter 34 receives the system clock SCLK, the frame synchronizing signal FCLK, the vertical synchronizing signal VCLK and the horizontal synchronizing signal HCLK from the controller 35. Further, the driver input data converter 34 receives grayscale data HD from the frame memory 31 in synchronization with the horizontal synchronizing signal HCLK from the controller 35. Subsequently, when receiving grayscale data HD for one line from the frame memory 31, the driver input data converter 34 receives any one of the first mode signal M1 to the fourth mode signal M4 from the grayscale data average value operation unit 33 in synchronization with the vertical synchronizing signal VCLK.

Figure 5:
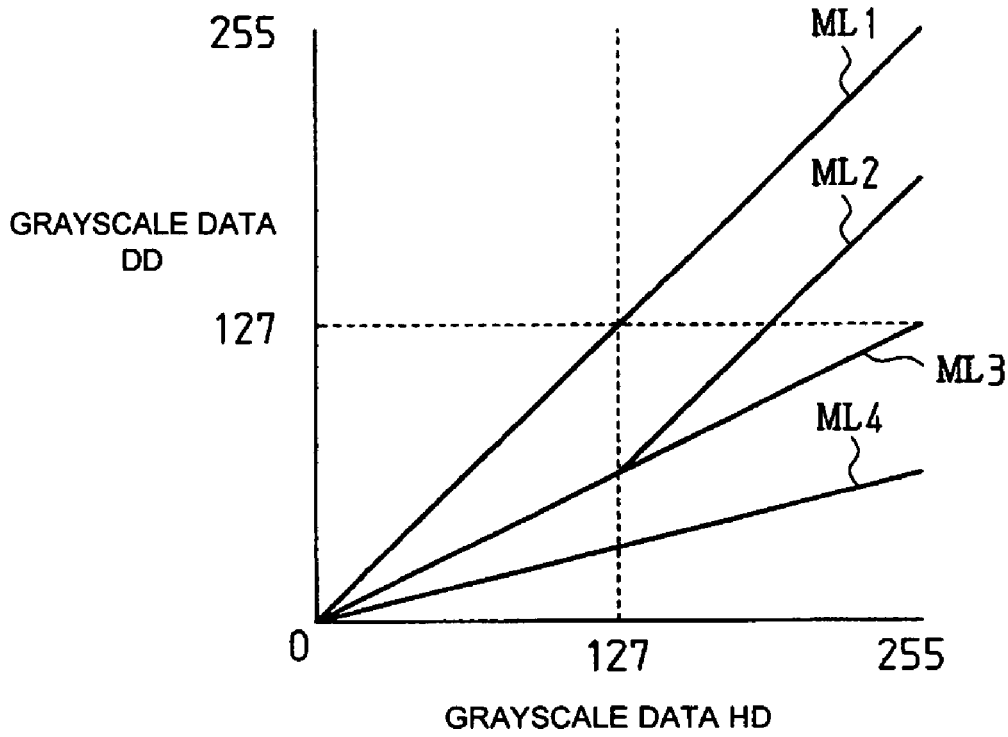
FIG. 5 is a graph for explaining data conversion for peak brightness control in the organic electroluminescent display device of the first embodiment.

In other words, whenever the driver input data converter 34 receives grayscale data HD for one line from the frame memory 31, it converts grayscale data HD for one line for the peak brightness control based on the first mode signal M1 to the fourth mode signal M4 from the grayscale data average value operation unit 33. As shown in FIG. 5, the driver input data converter 34 is provided with a conversion table with regard to respective grayscale data HD for one line according to the respective mode signals M1 to M4. More specifically, when the first mode signal M1 is received, the driver input data converter 34 converts respective grayscale data HD for one line into peak-brightness-adjusted grayscale data DD in accordance with a characteristic line ML1 shown in FIG. 5. Further, when the second mode signal M2 is received, the driver input data converter 34 converts respective grayscale data HD for one line into peak-brightness-adjusted grayscale data DD in accordance with a characteristic line ML2. In addition, when the third mode signal M3 is received, the driver input data converter 34 converts respective grayscale data HD for one line into peak-brightness-adjusted grayscale data DD in accordance with a characteristic line ML3. And then, when the fourth mode signal M4 is received, the driver input data converter 34 converts respective grayscale data HD for one line into peak-brightness-adjusted grayscale data DD in accordance with a characteristic line ML4.

In detail, in the present embodiment, even though the first mode signal M1 indicating that the average value is in a very dark state is received, by using the characteristic line ML1, grayscale data HD is converted into peak-brightness-adjusted grayscale data DD one to one.

Further, in the present embodiment, even though the second mode signal M2 indicating that the average value is a little dark state is received, by using the characteristic line ML2, the grayscale data HD is converted into peak-brightness-adjusted grayscale data DD, in which 0 to 127 grayscale levels of grayscale data HD are converted at a rate of a half and 128 more grayscale levels at a same rate as the characteristic line ML1.

In addition, in the present embodiment, when the third mode signal M3 indicating that the average value is a little bright state is received, by using the characteristic ML3, the grayscale data HD is converted into peak-brightness-adjusted grayscale data DD at a rate of a half.

Further, in the present embodiment, when the fourth mode signal M4 indicating that the average value is very bright state is received, the grayscale data HD is converted into peak-brightness-adjusted grayscale data DD at a rate of a fourth.

In such a manner, grayscale data DD for one line peak-brightness-adjusted in the driver input data converter 34 (the brightness control circuit 12) are outputted to the data line driving circuit 16 through the signal generating circuit 13 in synchronization with the horizontal synchronizing signal HCLK. Subsequently, when grayscale data DD for one line is inputted to the data line driving circuit 16, a scanning line corresponding to grayscale data DD for one line is selected. If so, grayscale data DD for one line are respectively supplied for the pixel circuits 20 on the selected scanning line via the corresponding data lines X1 to Xm as the data voltages Vdata1 to Vdatam. Accordingly, the organic electroluminescent elements OLED in the pixel circuits 20 respectively emit with brightness corresponding to the data voltages Vdata1 to Vdatam. After then, these actions are repeated whenever a scanning line is selected, thereby displaying images on the display panel 14.

Next, effects of the above embodiment will be now described.

(1) In the present embodiment, the brightness control circuit 12 receives grayscale data HD for one line, converts input grayscale data HD for one line into peak-brightness-adjusted grayscale data DD, using grayscale data HD for one frame previously inputted containing input grayscale data HD for the one line, and outputs peak-brightness-adjusted grayscale data DD. Accordingly, since grayscale data HD for one line are peak-brightness-adjusted using grayscale data HD for one frame previously inputted containing grayscale data HD for one line, unlike a conventional peak brightness control, brightness is changed smoothly. Accordingly, the brightness is changed smoothly based on the peak brightness control, and then a change in electric power is made little. In other words, it is possible to prevent a large current from flowing when switching frames.

(2) In the present embodiment, whenever grayscale data HD for one line is inputted, input grayscale data HD for one line is converted into peak-brightness-adjusted grayscale data DD. Therefore, it is possible to control peak brightness in detail.

(3) The grayscale data average value operation unit 33 obtains an average value of grayscale data HD for one frame using only an upper 2-bit of 8-bit grayscale data HD. Therefore, it is possible to reduce a load of an operation for obtaining an average value of grayscale data HD for one frame, and further it is possible to decrease a circuit size of the grayscale data average value operation unit 33.

(4) In the present embodiment, an average value of grayscale data HD for one frame is obtained in every one line, a brightness control mode is selected based on the average value, and grayscale data are converted into driver input data.

According to the present embodiment, it is not required for obtaining an average value of grayscale data HD for one frame, adjusting peak brightness of grayscale data HD for one frame based on the average value, and writing them in the display panel unit 14, like a conventional art.

Second Embodiment

A specific second embodiment of the present invention will be now described. The present embodiment has a feature of the grayscale data average value operation unit 33 in the brightness control circuit 12 described in the first embodiment. Accordingly, for convenience, the grayscale data average value operation unit 33 will be described with reference to FIGS. 6 to 8.

Figure 6:
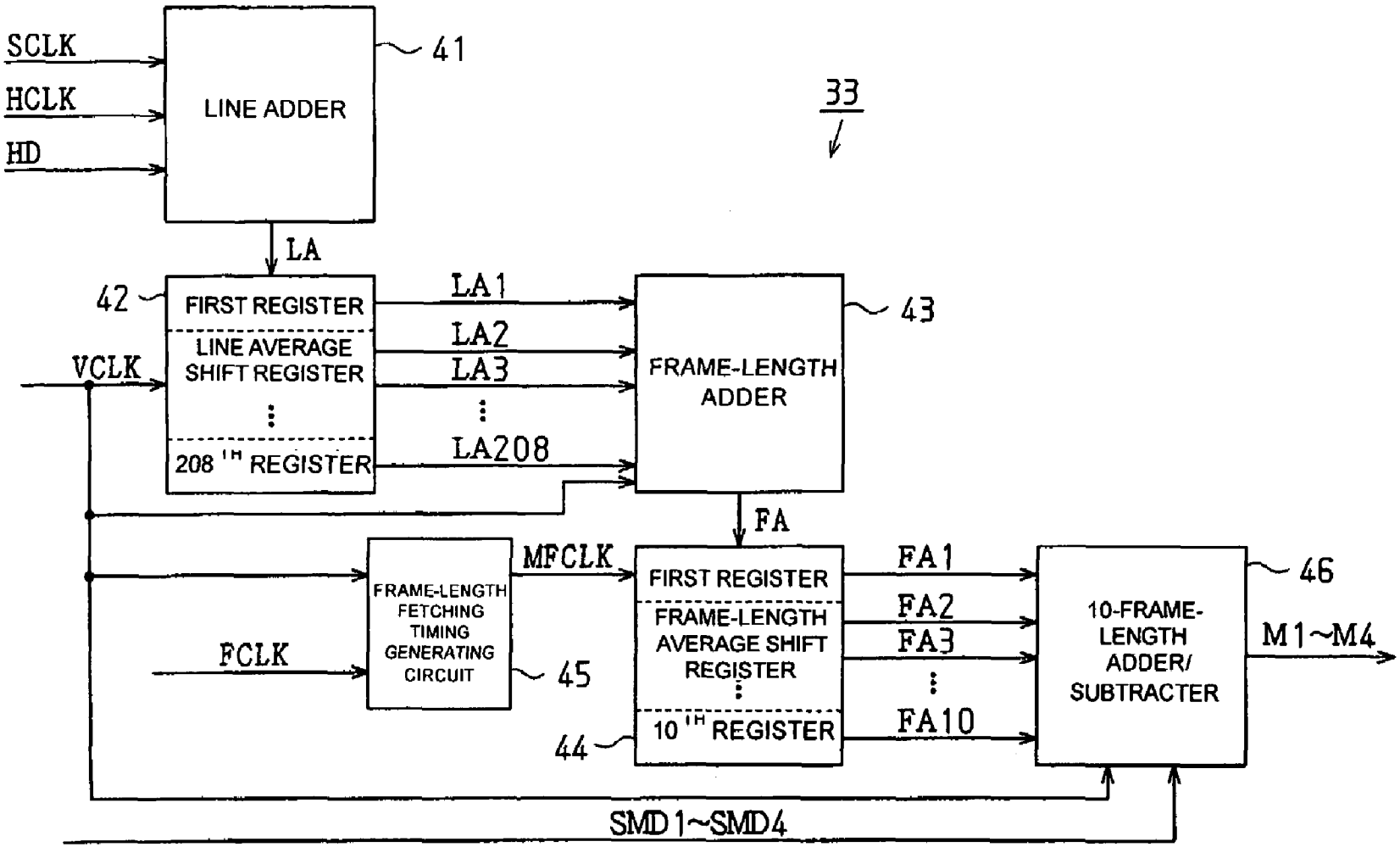
FIG. 6 is a view showing an inside configuration of grayscale data average value operation unit of a second embodiment.

In FIG. 6, the grayscale data average value operation unit 33 comprises a line adder 41 which is a first adding circuit, a line average shift register 42 which is a shift circuit and a first shift circuit, a frame-length adder 43 which is a second adding circuit, a frame-length average shift register 44 which is a second shift circuit, a frame-length fetching timing generating circuit 45 and a ten-frame-length adder/subtracter 46. Moreover, for convenience, the number of scanning lines is 208 and the number of data lines is 528.

Figure 8:
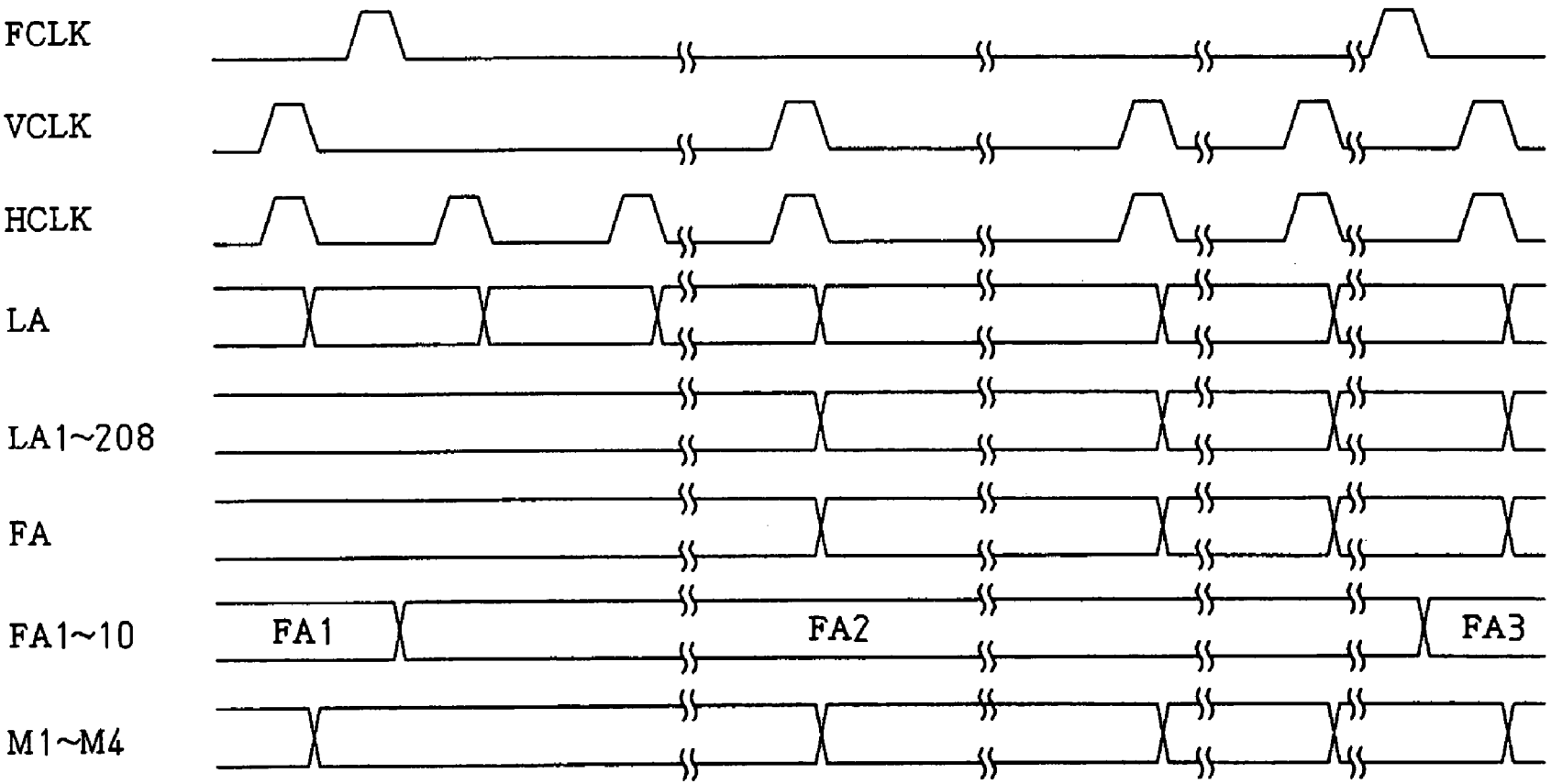
FIG. 8 is a timing chart of a grayscale data average value operation unit in the second embodiment.

The line adder 41 receives grayscale data HD every one pixel (one pixel circuit 20) from the frame memory 31 in synchronization with the horizontal synchronizing signal HCLK, and sequentially adds input grayscale data HD. Further, if grayscale data HD for one line (528) are added according to 528 horizontal synchronizing signals HCLK, the line adder 41 outputs the added value for one line (528) as line general brightness value LA to the line average shift register 42, in synchronization with the vertical synchronizing signal VCLK from the controller 35, as shown in FIG. 8.

The line average shift register 42 has first through 208th registers. The line average shift register 42 receives new line general brightness value LA from a line adder 41 in synchronization with the vertical synchronizing signal VCLK, and the respective line general brightness values LA1 to LA208 as output data of the respective registers are shifted to the next stage register.

In other words, the line general brightness value LA1 stored in the first register is rewritten into the second register as the line general brightness value LA2, and the line general brightness value LA2 stored in the second register is rewritten into the third register as the line general brightness value LA3. And then, finally, the line general brightness value LA208 stored in the 208th register is removed, and the line general brightness value LA207 stored in the 207th register is rewritten as the line general brightness value LA208. At this time, in the first register, new line general brightness value LA from the line adder 41 is stored as the line general brightness value LA1.

Subsequently, to the line average shift register 42, the vertical synchronizing signal VCLK is inputted, and the respective line general brightness values LA1 to LA208 in the first to 208th registers are outputted to the frame-length adder 43.

When the frame-length adder 43 receives the line general brightness values LA1 to LA208 stored in the first through 208th registers in synchronization with the vertical synchronizing signal VCLK and adds overall the line general brightness values LA1 to LA208. In other words, if the line adder 41 calculates the line general brightness value LA for one line, the frame-length adder 43 adds a sum of the line general brightness value LA (=LA1) for the one line and 207 line general brightness values LA2 to LA207 previously obtained, that is, general brightness value for one frame. As shown in FIG. 8, the frame-length adder 43 outputs the obtained general brightness value to the frame-length average shift register 44 as the frame general brightness value for one frame FA.

The frame-length average shift register 44 has first through tenth registers. The frame-length average shift register 44 receives the frame general brightness value FA from the frame-length adder 43 in synchronization with a clock MFCLK from the frame-length fetching timing generating circuit 45, and shifts the frame general brightness values FA1 to FA10 which are output data of the respective registers to the next state register. In other words, the frame general brightness value FA1 stored in the first register is rewritten into the second register as the frame general brightness value FA2, and the frame general brightness value FA2 stored in the second register is rewritten into the third register as the frame general brightness value FA3. And then, finally, the frame general brightness value FA10 stored in the tenth register is removed, and the frame general brightness value FA9 stored in the ninth register is rewritten as the frame general brightness value FA10. At this time, in the first register, new frame general brightness value FA from the frame-length adder 43 is stored as the frame general brightness value FA1. Subsequently, the frame-length average shift register 44, in response to the clock MFCLK, outputs the current frame general brightness values FA1 to FA10 in the first to tenth register to the ten-frame-length adder/subtracter 46.

The frame-length fetching timing generating circuit 45 generates a clock MFCLK determining a timing at which the frame general brightness values FA1 to FA10 are outputted from the frame-length average shift register 44 to the 10-frame-length adder/subtracter 46. The frame-length fetching timing generating circuit 45 receives the vertical synchronizing signal VCLK and the frame synchronizing signal FCLK and outputs the clock MFCLK. In the present embodiment, the frame-length fetching timing generating circuit 45 outputs the clock MFCLK whenever the frame general brightness value FA is obtained in the frame-length adder 43 and outputted to the frame-length average shift register 44.

Figure 7:
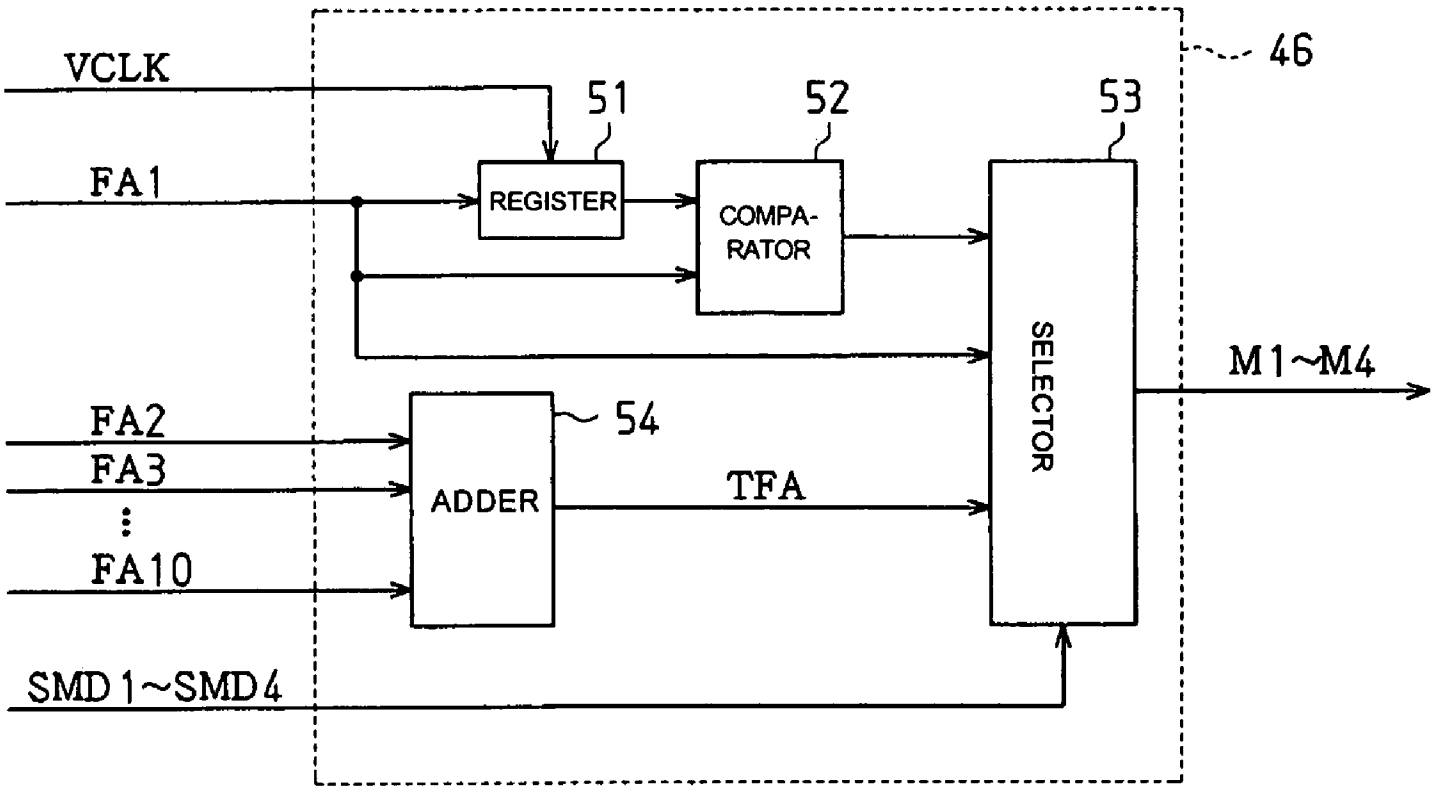
FIG. 7 is a view showing an inside configuration of a ten-frame-length adder/subtracter of a second embodiment.

As shown in FIG. 7, the ten-frame-length adder/subtracter 46 comprises a register 51, a comparator 52, a selector 53 which is a judging circuit, a brightness mode selecting circuit and a selecting circuit, an adder 54 which is a third adding circuit. The register 51 stores the frame general brightness value FA1 of the first register of the frame-length average shift register 44. Subsequently, the register 51 outputs the stored frame general brightness value FA1 to the comparator 52 in synchronization with the vertical synchronizing signal, and stores the frame general brightness value FA1 to be newly outputted from the first register of the frame-length average shift register 44.

The comparator 52 receives the frame general brightness value FA1 of the first register of the frame-length average shift register 44 and the previous frame general brightness value FA1 stored in the register 51, and compares them with each other. If the frame general brightness value FA1 of the first register is more than the frame general brightness value FA1 stored in the register 51, the comparator 52 judges that the general brightness tends to brighten and outputs the judgment result to the selector 53. To the contrary, if the frame general brightness value FA1 is less than the frame general brightness value FA1 stored in the register 51, the comparator 52 judges that the general brightness tends to darken and outputs the judgment result to the selector 53.

The adder 54 receives and adds the frame general brightness values FA2 to FA10 stored in the second through tenth registers of the frame-length average shift register 44. The adder 54 outputs the added value to the selector 53 as the nine-frame general brightness value TFA.

The selector 53 receives the frame general brightness value FA1 stored in the first register of the frame-length average shift register 44, as well as the judgment result of the comparator 52 and the nine-frame general brightness value TFA from the adder 54. Further, the selector 53 receives any one of first through fourth mode selection signals SMD1 to SMD4. The respective mode selection signals SMD1 to SMD4 indicate one of four control modes when the peak brightness control, and is set to be a predetermined one when shipping.

In addition, if the first mode selection signal SMD1 is inputted, the selector 53 calculates an average value of brightness for one frame using only the frame general brightness value FA1 stored in the first register, regardless of the judgment result of the comparator 52. Subsequently, if the average value is in a range of 0 to 127, the selector 53 judges as the first mode and outputs the first mode signal M1 to the driver input data converter 34 shown in FIG. 4. Further, if the average value is in a range of 128 to 255, the selector 53 judges as the third mode and outputs the third mode signal M3 to the driver input data converter 34.

Next, if the second mode selection signal SMD2 is inputted, the selector 53 calculates an average value of brightness for one frame using only the frame general brightness value FA1 stored in the first register regardless of the judgment result of the comparator 52. Subsequently, similarly to the first embodiment, if the average value is in a range of 0 to 25, the selector 53 judges as the first mode and outputs the first mode signal M1 to the driver input data converter 34, and if the average value is in range of 26 to 50, the selector judges as the second mode and outputs the second mode signal M2 to the driver input data converter 34. Further, if the average value is in a range of 51 to 75, the selector 53 judges as the third mode and outputs the third mode signal M3 to the driver input data converter 34, and if the average value is in a range of 76 to 100, the selector 53 judges as the fourth mode and outputs the fourth mode signal M4 to the driver input data converter 34.

Next, if the third mode selection signal SMD3 is inputted, the selector 53 changes a generating method of the first through fourth mode signals M1 to M4 based on the judgment result of the comparator 52. If the comparator 52 judges that the general brightness tends to brighten, the selector 53 calculates an average value of brightness for one frame using only the frame general brightness value FA1 stored in the first register. Subsequently, if the average value is in a range of 0 to 127, the selector 53 judges as the first mode and outputs the first mode signal M1 to the driver input data converter 34, and if the average value is in a range of 128 to 255, the selector 53 judges as the third mode and outputs the third mode signal M3 to the driver input data converter 34, as shown in FIG. 4.

Meanwhile, if the comparator 52 judges that the general brightness tends to darken, the selector 53 calculates an average value of brightness for one frame using the frame general brightness value FA1 stored in the first register and the nine-frame general brightness value TFA from the adder 54. That is, the selector 53 obtains a sum of the frame general brightness values FA1 to FA10 of the respective registers of the frame-length average shift register 44, and divides the sum by the number of frames and the number of pixel circuits, to thereby obtain the average value. Subsequently, if the average value is in a range of 0 to 127, the selector 53 judges as the first mode and outputs the first mode signal M1 to the driver input data converter 34, and if the average value is in a range of 128 to 255, the selector 53 judges as the third mode and outputs the third mode signal M3 to the driver input data converter 34.

Next, if the fourth mode selection signal SMD4 is inputted, the selector 53 changes a generating method of the first through fourth mode signals M1 to M4 based on the judgment result of the comparator 52. If the comparator 52 judges that the general brightness tends to brighten, the selector 53 calculates an average value of brightness for one frame using only the frame general brightness value FA1 stored in the first register. Subsequently, if the average value is in a range of 0 to 25, the selector 53 judges as the first mode and outputs the first mode signal M1 to the driver input data converter 34, and if the average value is in range of 26 to 50, the selector judges as the second mode and outputs the second mode signal M2 to the driver input data converter 34. Further, if the average value is in a range of 51 to 75, the selector 53 judges as the third mode and outputs the third mode signal M3 to the driver input data converter 34, and if the average value is in a range of 76 to 100, the selector 53 judges as the fourth mode and outputs the fourth mode signal M4 to the driver input data converter 34.

Meanwhile, if the comparator 52 judges that the general brightness tends to darken, the selector 53 calculates an average value of brightness for one frame using the frame general brightness value FA1 stored in the first register and the nine-frame general brightness value TFA from the adder 54. That is, the elector 53 obtains a sum of the frame general brightness values FA1 to FA10 of the respective registers of the frame-length average shift register 44, and divides the sum by the number of frames and the number of pixel circuits, to thereby obtain the average value. Subsequently, if the average value is in a range of 0 to 25, the selector 53 judges as the first mode and outputs the first mode signal M1 to the driver input data converter 34, and if the average value is in range of 26 to 50, the selector judges as the second mode and outputs the second mode signal M2 to the driver input data converter 34. Further, if the average value is in a range of 51 to 75, the selector 53 judges as the third mode and outputs the third mode signal M3 to the driver input data converter 34, and if the average value is in a range of 76 to 100, the selector 53 judges as the fourth mode and outputs the fourth mode signal M4 to the driver input data converter 34.

According to the present embodiment, in addition to effects of the first embodiment, the following effect is obtained.

(5) In the present embodiment, four types of peak brightness controls based on the first through fourth selection signals SMD1 to SMD4 are performed in the selector 53, and thus it is possible to select flexible peak brightness control in accordance with usages of the organic electroluminescent display device 10.

Moreover, in the present embodiment, when calculating the line general brightness values LA, the number of bits of 8-bit grayscale data HD has not particularly limited, but, similarly to the first embodiment, it is configured such that the line general brightness value LA, the average value for one frame or the like are obtained using upper two bits of 8-bit grayscale data HD. In such a manner, it is possible to reduce a circuit size of the grayscale data average operation unit 33, and further it is possible to decrease the operation load.

Third Embodiment

Next, an example in which an organic electroluminescent display device 10 using an organic electroluminescent element as an electro-optical device described in the first and second embodiments is applied to an electronic apparatus will be now described with reference to FIG. 9. The organic electroluminescent display device 10 can be applied to personal digital assistants such as mobile type personal computers, cellular phones, viewers, game machines, and various electronic apparatuses such as electronic books and electronic papers. Further, the organic electroluminescent display device 10 can also be applied to various electronic apparatuses such as video cameras, digital still cameras, car navigations, car stereos, driving operating panels, personal computers, printers, scanners, televisions, video players.

Figure 9:
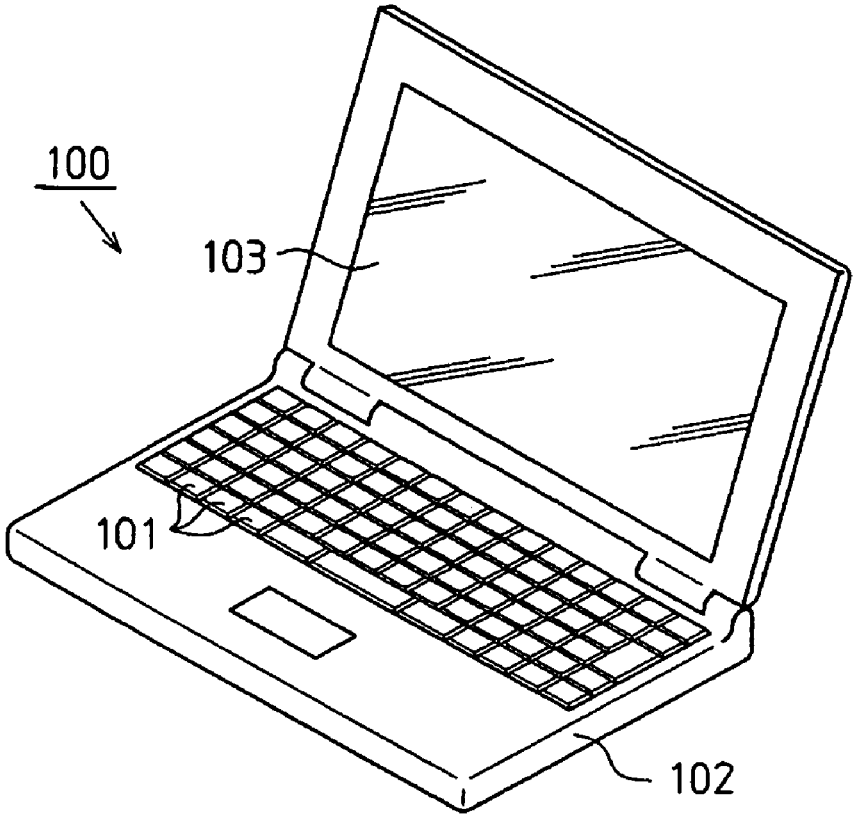
FIG. 9 is a perspective view showing a configuration of a mobile type personal computer for explaining a third embodiment.

FIG. 9 is a perspective view showing a configuration of a mobile type personal computer. In FIG. 9, a mobile type personal computer 100 comprises a main body portion 102 having a keyboard 101, and a display unit 103 using the organic electroluminescent display device 10. In this case, the display unit 103 using the organic electroluminescent display device 10 exhibits the same effects as those of the first and second embodiments. As a result, the mobile type personal computer 100 can control more smoothly brightness of a display portion in the peak brightness control, and then it is possible to realize high display quality as well as a reduction of power consumption.

Moreover, the present embodiment may be modified as follows.

In the above embodiments, the driver input data converter 34 has converted 8-bit grayscale data HD into 8-bit grayscale data DD in accordance with the characteristic lines ML1 to ML4, as shown in FIG. 5. That is, the data voltages Vdata1 to Vdatam to be written in the respective pixel circuits 20 through the respective data lines X1 to Xm has changed for the peak brightness control.

Figure 10:
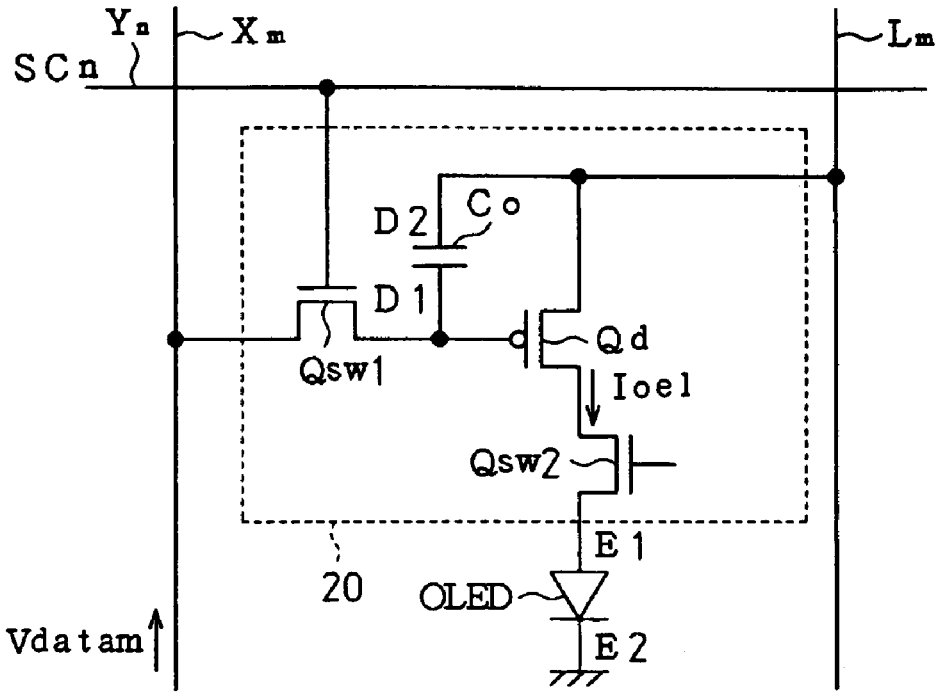
FIG. 10 is a circuit diagram for explaining a pixel circuit of another example.

Alternatively, without changing the data voltages Vdata1 to Vdatam for the peak brightness control, the light-emitting interval of the organic electroluminescent element OLED of the pixel circuit 20 may be controlled based on the average value which is calculated by the grayscale data average value operation unit 33. In this case, a pixel circuit 20 shown in FIG. 10 is used. The pixel circuit 20 shown in FIG. 10 is different from the pixel circuit 20 of the first embodiment in that a drive starting transistor Qsw2 is provided between the driving transistor Qd and the organic electroluminescent element OLED. Further, respective gates of the respective drive starting transistors Qsw2 of the respective pixel circuits 20 on the same scanning line are connected to a common signal line.

In the organic electroluminescent element OLED, when the drive starting transistor Qsw2 is turned on, the driving current Ioel flows, and thus the organic electroluminescent element OLED emits. To the contrary, in the organic electroluminescent element OLED, when the drive starting transistor Qsw2 is turned off, the driving current Ioel does not flow, and thus organic electroluminescent element OLED does not emit. In other words, by determining turn-on and turn-off timing of the drive starting transistor Qsw2 based on the average value calculated by the grayscale data average value operation unit 33, it is possible to adjust the light-emitting intervals in which a peak brightness is controlled.

In such a manner, it is possible to obtain the same effects as those of the above embodiment and realize brightness adjustment only by turning on and off a single driving start transistor Qsw2. Therefore, it is possible to reduce the circuit size.

In the above embodiments, based on the average value of brightness as the brightness state, one of the first through fourth modes is selected, but based on the general brightness value prior to calculating the average value of brightness, one of the first through fourth modes may be selected.

In the above embodiments, grayscale data HD is 8-bit, peak brightness control is performed according to 8-bit grayscale data. Alternatively, it may be applied to control peak brightness of grayscale data other than 8-bit grayscale data. As a result, the same effect as the above embodiment can be obtained.

In the above embodiments, whenever grayscale data HD for one line is inputted, a brightness state of grayscale data HD for one frame previously inputted and including grayscale data HD for one line is judged. Alternatively, whenever grayscale data for plural lines such as two lines, three lines or more is inputted, a brightness state of grayscale data HD for one frame previously inputted and including grayscale data HD for plural lines may be judged.

In the above embodiments, the brightness control circuit 12 uses only upper two bits of respective grayscale data HD and judges a brightness state. Alternatively, it is possible to use the number of bits other than two bits. Further, the number of bits of respective adding circuits provided in the grayscale data average value operation unit 33 may be changed.

In the above embodiments, the brightness control circuit 12 comprises the frame memory 31, but, with no frame memory 31, it may be configured that grayscale data is directly inputted to the grayscale data average value operation unit 33 and the driver input data converter 34 from the host I/F 11.

In the above embodiments, the organic electroluminescent display device 10 is provided with the pixel circuits 20 of the organic electroluminescent element OLED comprising one color. Alternatively, an organic electroluminescent display device which are provided with pixel circuits 20 for each color in three colors of red, green and blue colors of an organic electroluminescent display device OLED may be utilized.

In the above embodiments, it has obtained desirable effects by implementing the pixel circuit 20, but, it may be implemented as an unit circuit for driving the current-driven elements such as LED or FED other than the organic electroluminescent element OLED. It may be implemented on a memory device such as RAM (in particular, MRAM).

In the above embodiments, an organic EL element OLED has been specified as a current-driven element, but an inorganic EL element may also be specified. In other words, the present invention may be applied to an inorganic electroluminescent display device which comprises an inorganic electroluminescent element.

In the above embodiments, a configuration which use an organic electroluminescent element has been described, but the present invention is not limited to such a configuration. For example, the present invention can also be applied to a liquid crystal element, a digital micromirror device (DMD), FED (field emission display) or SED (surface-conduction electron-emitter display).

What is claimed is:

1. An electro-optical device comprising:

a plurality of scanning lines;

a plurality of data lines;

pixel circuits having electro-optical elements respectively provided corresponding to intersections of the plurality of scanning lines and the plurality of data lines; and a brightness control circuit for controlling the brightness of the electro-optical element of each pixel circuit, based on grayscale data, to control peak brightness, the brightness control circuit comprising:

a brightness state judging circuit for, whenever grayscale data for one line or plural lines defining a partial frame is inputted, calculating a brightness state for one frame-length including the one line or plural lines defining a partial frame and judging the brightness state based on the calculation result, wherein the brightness state judging circuit comprises:

a first adding circuit for, whenever grayscale data for one line or plural lines is inputted, respectively adding grayscale data for the one line or plural lines;

a shift circuit for holding the addition result of the first adding circuit for one frame-length;

a second adding circuit for, whenever grayscale data for one line or plural lines is inputted, respectively adding output data of the shift circuit corresponding to the number of lines for the one frame-length including the one line or plural lines;

a judging circuit for, whenever grayscale data for one line or plural lines is inputted, judging the brightness state for the one frame-length including the one line or plural lines based on the addition result of the second adding circuit; and a brightness mode selecting circuit for selecting one mode from a plurality of brightness modes based on the judgment result of the judging circuit; and a brightness control circuit for, whenever grayscale data for the one line or plural lines is inputted, controlling the brightness of electro-optical elements of pixel circuits for one line or plural lines based on the judgment result of the brightness state judging circuit.

2. An electro-optical device comprising:

a plurality of scanning lines;

a plurality of data lines;

pixel circuits having electro-optical elements respectively provided corresponding to intersections of the plurality of scanning lines and the plurality of data lines; and a brightness control circuit for controlling the brightness of the electro-optical element of each pixel circuit, based on grayscale data, to control peak brightness, the brightness control circuit comprising:

a brightness state judging circuit for, whenever grayscale data for one line or plural lines defining a partial frame is inputted, calculating a brightness state for one frame-length including the one line or plural lines defining a partial frame and judging the brightness state based on the calculation result, wherein the brightness state judging circuit composes:

a first adding circuit for, whenever grayscale data for one line or plural lines is inputted, respectively adding grayscale data for the one line or plural lines;

a first shift circuit for holding the addition result of the first adding circuit for one frame-length;

a second adding circuit for, whenever grayscale data for one line or plural lines is inputted, respectively adding output data of the first shift circuit corresponding to a number of lines for the one frame-length including the line or plural lines;

a second shift circuit for holding the addition result of the second adding circuit for multiple frame-lengths;

a third adding circuit for, whenever grayscale data for one line or plural lines is inputted, respectively adding output data of the second shift circuit corresponding to the number of lines for the multiple frame-lengths including the line or plural lines;

a judging circuit for, whenever grayscale data for one line or plural lines is inputted, judging the brightness state for the one frame-length including the line or plural lines based on the addition result of the third adding circuit; and a selecting circuit for selecting one mode from a plurality of brightness modes based on the judgment result of the judging circuit.

3. An electro-optical device comprising:

a plurality of scanning lines;

a plurality of data lines;

pixel circuits having electro-optical elements respectively provided corresponding to intersections of the plurality of scanning lines and the plurality of data lines; and a brightness control circuit for controlling the brightness of the electro-optical element of each pixel circuit, based on grayscale data, to control peak brightness, the brightness control circuit comprising:

a brightness state judging circuit for, whenever grayscale data for one line or plural lines consisting defining a partial frame is inputted, calculating a brightness state for one frame-length including the one line or plural lines consisting defining a partial frame and judging the brightness state based on the calculation result, wherein the brightness state judging circuit comprises:

a first adding circuit for, whenever grayscale data for one line or plural lines is inputted, respectively adding grayscale data for the one line or plural lines;

a first shift circuit for holding the addition result of the first adding circuit for one frame-length;

a second adding circuit for, whenever grayscale data for one line or plural lines is inputted, respectively adding output data of the first shift circuit corresponding to a number of lines for the one frame-length including the line or plural lines;

a second shift circuit for holding the addition result of the second adding circuit for multiple frame-lengths;

a third adding circuit for, whenever grayscale data for one line or plural lines is inputted, respectively adding output data of the second shift circuit corresponding to the number of lines for the multiple frame-lengths including the line or plural lines;

a selecting circuit for selecting one of the addition result of the second adding circuit and the addition result of the third adding circuit according to changes in the brightness state for the one frame-length;

a judging circuit for, whenever grayscale data for one line or plural lines is inputted, judging the brightness state for the one frame-length including the one line or plural lines based on the selection result of the selecting circuit; and a brightness mode selecting circuit for selecting one mode from a plurality of brightness modes based on the judgment result of the judging circuit.

4. The electro-optical device according to claim 1, wherein the brightness control circuit comprises:

a converting circuit for converting grayscale data according to a brightness mode selected by the brightness mode selecting circuit.

5. The electro-optical device according to claim 1, wherein the brightness control circuit sets one light-emitting interval of a plurality of light-emitting intervals of the pixel circuits according to a brightness mode selected by the brightness mode selecting circuit.

6. A method of driving an electro-optical device comprising a plurality of scanning lines, a plurality of data lines, pixel circuits having electro-optical elements respectively provided corresponding to intersections of the plurality of scanning lines and the plurality of data lines, and a brightness control circuit for controlling the brightness of the electro-optical element of each pixel circuit, based on grayscale data, to control peak brightness, the method comprising:

whenever grayscale data for one line or plural lines defining of a partial frame is inputted, calculating a brightness state for one frame-length including the one line or plural lines defining of a partial frame by, whenever grayscale data for one line or plural lines is inputted, respectively adding grayscale data for the one line or plural lines to create a first addition result, holding the first addition result for one frame-length, and whenever grayscale data for one line or plural lines is inputted, respectively adding output data corresponding to a number of lines for the one frame-length including the one line or plural lines to create a second addition result;

judging the brightness state based on the calculation result by judging the brightness state for the one frame-length including the one line or plural lines based on the second addition result and selecting one mode from a plurality of brightness modes based on the judgment result; and whenever grayscale data for one line or plural lines is inputted, controlling the brightness for the one line or plural lines based on the judgment result.

7. The method of driving an electro-optical device according to claim 6, wherein the control of brightness for one line or plural lines based on the judgment result is performed by changing the grayscale data.

8. The method of driving an electro-optical device according to claim 6, wherein the control of the brightness for one line or plural lines based on the judgment result is performed by changing a driving interval of the electro-optical device.

9. An electronic apparatus in which an electro-optical device according to claim 1 is contained.

* * * * *